United States Patent [19]

Guignard

[11] Patent Number: 4,843,776

[45] Date of Patent: Jul. 4, 1989

[54] BRICK TIE

[76] Inventor: Alvin Guignard, P.O. Box 57, Allardville, New Brunswick, Canada, E0B 1A0

[21] Appl. No.: 221,397

[22] Filed: Jul. 19, 1988

[51] Int. Cl.[4] ..... E04B 1/41

[52] U.S. Cl. ..... 52/714; 52/434; 52/710; 52/713

[58] Field of Search ..... 52/379, 434, 479, 487–489, 52/562–564, 568, 665, 710, 712–715, 513

[56] References Cited

U.S. PATENT DOCUMENTS

| | | | |
|---|---|---|---|
| 1,934,760 | 11/1933 | Aubrey | 52/713 X |
| 2,369,100 | 2/1945 | Young | 52/479 |
| 3,103,263 | 9/1963 | Leeser | 52/715 X |
| 4,021,990 | 5/1977 | Schwalberg | 52/714 |
| 4,112,636 | 9/1978 | Hays | 52/98 |
| 4,433,524 | 2/1984 | Matson | 52/665 |
| 4,596,102 | 6/1986 | Catani et al. | 52/508 |
| 4,606,163 | 8/1986 | Catani | 52/434 |

FOREIGN PATENT DOCUMENTS

| | | | |
|---|---|---|---|
| 23244 | of 1929 | Australia | 52/710 |

*Primary Examiner*—David A. Scherbel
*Assistant Examiner*—Richard E. Chilcot, Jr.
*Attorney, Agent, or Firm*—Robert F. Delbridge; Arne I. Fors

[57] ABSTRACT

A brick tie for anchoring a brick wall to a vertical channel-shaped member open on one side and to which a drywall has already been secured. The brick tie has a first part with a body portion insertable into the channel-shaped member through the open side thereof and wedgeable therein, and a second part attachable to the first part and positionable between adjacent bricks as the wall is being constructed, with one of the parts passing through the drywall.

14 Claims, 3 Drawing Sheets

38
122
114
34
120
42
40
36
130
128
110
138
126
44
116
32
112
124
126
46
48
50
136
124
54
112
52
126

BRICK TIE

DISCLOSURE

This invention relates to brick ties of the kind which are used for anchoring a brick wall to a vertical channel-shaped member to which a dry wall has already been secured.

It is common practice to provide buildings, for example light industrial buildings, with a brick exterior wall. Since such a wall may have considerable length and/or height, it is necessary to anchor the wall at intervals to other structure of the building. Such buildings usually also have a series of vertical channel-shaped members (known as studs) to which interior walls can be secured. It is also usual to secure a dry wall, for example exterior gypboard sheathing, preferably with the addition of separate vapour barrier sheet material, to the exterior of the channel-shaped members so that the dry wall lies between the channel-shaped members and the brick wall.

In the construction of such buildings, the brick wall is built by brick layers, while other tradesmen construct other parts of the building before the brick wall is built. The brick ties are secured to the channel-shaped members at predetermined positions by a person of the appropriate trade so that the brick ties project through the dry wall to enable a bricklayer to subsequently construct the exterior brick wall and cause the brick ties to be embedded in mortar between adjacent bricks.

Typical known arrangements are shown in U.S. Pat. Nos. 4,021,990 (Schwalberg) issued May 10, 1977, and 4,596,102 (Catani) issued June 24, 1986. In such prior art, the brick tie has a first part attached to a vertical channel-shaped member by screws which pass through the dry wall into the channel-shaped member, and a second part which is attached to the first part and is embedded in the brick wall. The second part is capable of adjustment relative to the first part to enable the bricklayer to properly position the second part between adjacent bricks. However, the attachment of the first parts of the brick ties to the channel-shaped members have to be carried out by a tradesman other than a bricklayer. This is inconvenient, particularly since such attachments have to be effected from the exterior of the building, i.e. on the exterior side of the dry wall. It is also difficult for the person concerned to correctly position the brick tie.

It is therefore an object of the invention to provide an improved brick tie which substantially overcomes the difficulties of such prior art brick ties.

According to the present invention, a brick tie comprises a first part having a body portion insertable into the channel-shaped member through the open side thereof and wedgeable therein, and a second part attachable to the first part and positionable between adjacent bricks as the wall is being constructed, with one of said parts passing through the dry wall.

The first part of the brick tie, in accordance with the invention, can consequently be secured to a channel-shaped member from within the building by a person of the appropriate trade. The desicred position can be readily determined by conventional measuring equipment, such as the laser measuring equipment now available in the art. The first part may be caused to project through the dry wall for the outside attachment of the second part thereto by a brick layer during construction of the brick wall, or the second part may be attached to the first part adjacent to the channel-shaped member and cause to pass through the dry wall to the outside for incorporation in the brick wall as it is being constructed by the brick layer.

The first part of the brick tie may be of sheet material, with the body portion having a main web-like member which extends horizontally across the channel-shaped member when wedged therein, the first flange extending downwardly from an end of the web-like member and a second flange extending upwardly from an opposite end of the web-like member. The said first and second flanges engage front and rear walls of the channel-shaped member when the first part is wedged therein.

The body portion of the first part of the brick tie may also have a flange extending upwardly from the side of the main web-like member and fourth flange extending downwardly from said side, the third and fourth flanges engaging a side wall of the channel-shaped member opposite the open side when the first part is wedged therein.

The first part of the brick tie may have a portion projecting from the body portion and positioned to pass through the dry wall to an exterior side thereof when the body portion is wedged in a channel-shaped member, with said projecting portion having means to enable the second part to be secured thereto on the exterior side of the dry wall.

The means on the projecting portion of the first part of the brick tie to enable the second part to be secured thereto may comprise an aperture therein, with the second part comprising a shaped rod-like member passable through the aperture so as to be secured to the first part. The aperture in the projecting portion may comprise a slot which is vertical when the body portion is wedged in a vertical channel-shaped member, with the second part being vertically moveable in the slot.

The first part of the brick tie may alternatively have a portion projecting from the body portion and position to project from the channel-shaped member when the body portion is wedged therein, with the second part having a rear wall extension passable through the dry wall, the projecting portion of the first part having means to enable the rearward extension of the second part to be secured thereto.

The means on the projecting portion of the first part of the brick tie may comprise at least one aperture, with the rearward extension of the second part comprising a rod-like member positioned in the said slot by means of at least one aperture to secure the second part to the first part.

Embodiments of the invention will now be described, by way of example, with reference to the accompanying drawings, of which:

Figure 1:
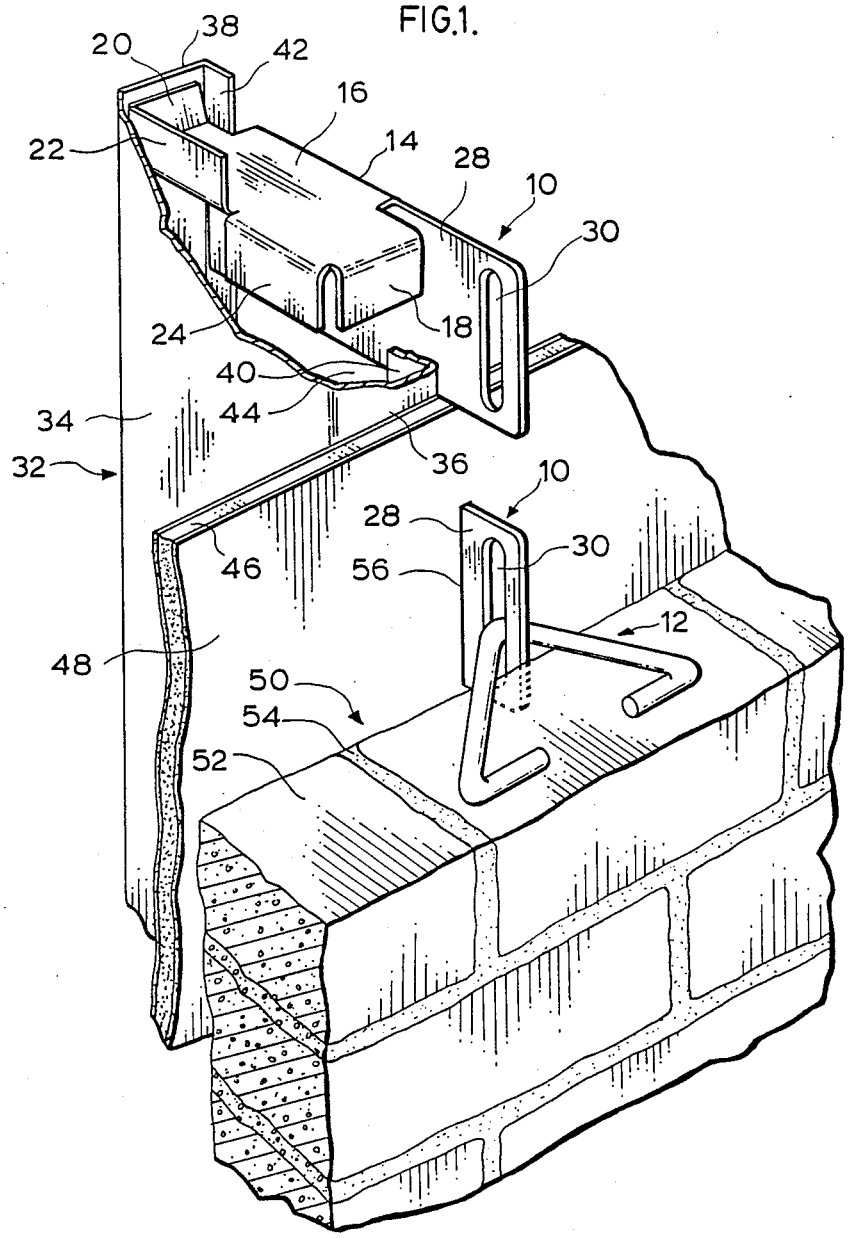
FIG. 1 is a broken away perspective view of the wall construction showing one embodiment of the invention.
Figure 2:
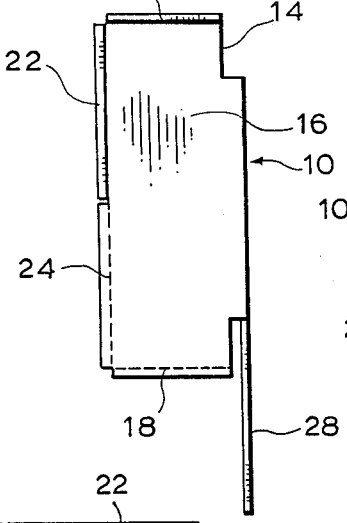
FIG. 2 is a plan view of the first part of the brick tie of FIG. 1.
Figure 3:
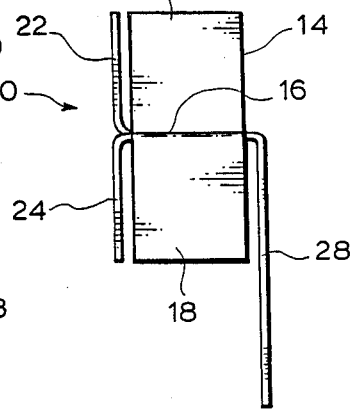
FIG. 3 is a front view thereof.
Figure 4:
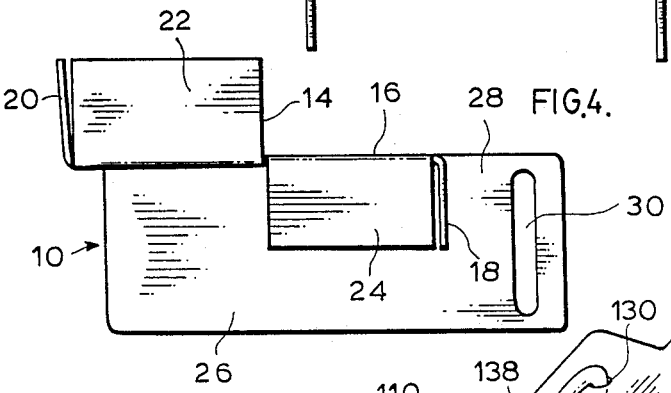
FIG. 4 is a left hand side view thereof.

Referring first to FIGS. 1 to 4 of the accompanying drawings, a brick tie has two parts 10, 12. The first part 10 is made of galvanized stainless steel sheet metal bent to the shape shown, with a body portion 14 having a horizontal main web-like member 16. A first flange 18 extends downwardly from the front end of the web-like member 16, and a seoond 20 extends upwardly from the rear end of the web-like member 16. A third flange 22 extends upwardly from the rear part of one side wall of the web-like member 16, and a fourth flange 24 extends downwardly from the front part of the same side of the web-like member 16.

The first part also has a fifth flange 26 which extends downwardly from the web-like member 16 on the opposite side thereof to flanges 22, 24. The fifth flange 26 extends forwardly beyond the body portion 14 to form a projecting portion 28. The projecting portion 28 has a vertical slot 30 near its free end.

The brick tie is used in a wall construction which has a series of vertical channel-shaped members 32 (only one of which is shown in FIG. 1). Each channel-shaped member 32 has a side wall 34, front wall 36, rear wall 38 and front and rear side flanges 40, 42 which extend rearwardly and forwardly a short distance from the front and rear walls 36, 38 respectively to form an opening 44 in the side of the channel-shaped member 32 opposite the side wall 34. A drywall panel 46 extends along the front of the channel-shaped members and may be provided with a vapour barrier sheet 48 on its front surface. The drywall panel 46 is secured to the channel-shaped members 32 in a conventional manner (not shown) which therefore need not be described here.

The wall construction also includes a brick wall 50 comprising bricks 52 and mortar 54, the brick wall 50 being spaced a short distance from the front of the drywall panel 46.

Before the brick wall 50 is constructed, a person of the appropriate trade installs the first parts 14 of the brick ties from inside the building being constructed. As mentioned earlier, the required position of each brick tie can readily be determined by persons skilled in the art using known laser measuring equipment. At the required brick tie position, a vertical slot 56 is cut in drywall panel 46 and vapour barrier 48. The installer then maneouvers the body portion 14 of the brick tie into the channel-shaped member through its side opening 44. This can be achieved by passing body portion 14 in an almost vertical orientation through the side opening 44. At the same time, the projecting portion 28 of the first part 10 of the brick tie is caused to pass through slot 56.

The body portion 14 is brought to a horizontal orientation to cause the front and rear flanges 18, 20 to wedge against the front and rear walls 36, 38 respectively of the channel-shaped member 32. The upward and downward side flanges 22, 24, engage the side wall 34 of the channel-shaped member 32 to assist in maintaining the body portion 14 in the desired orientation shown in FIG. 1.

When the brick wall 50 is subsequently being constructed by a bricklayer, it is a simple matter for the brick layer to insert a second brick tie part 12, through the slot 30 in the projecting portion 28 of the first brick tie part 10 so as to attach the second part 12 to the first part 10. The slot 30 provides a limited amount of vertical movement of the second part 12 relative to the first part 10. The second part 12 can thus be positioned on top of brick 52 as shown in FIG. 1, so that when mortar 54 is placed on top of the upper row of bricks 52 shown, and the next layer of bricks 52 is laid, the second brick tie part 12 will be embedded in the mortar.

Figure 6:
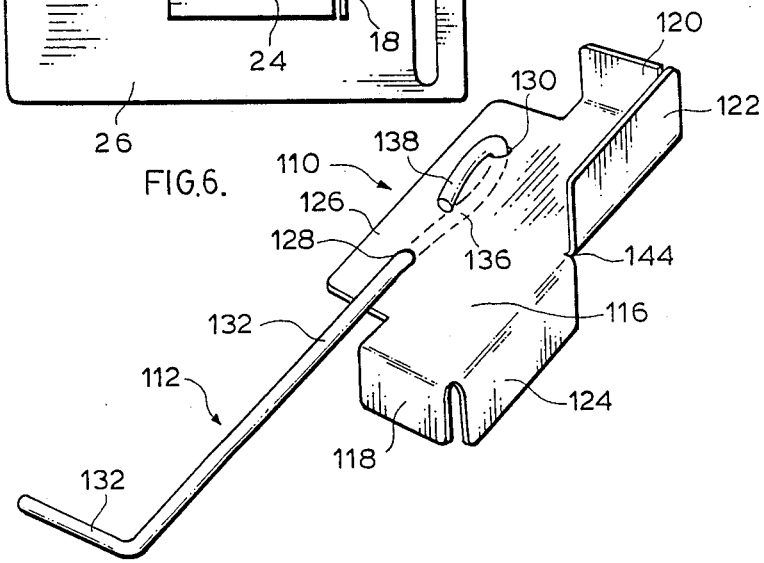
Figure 5:
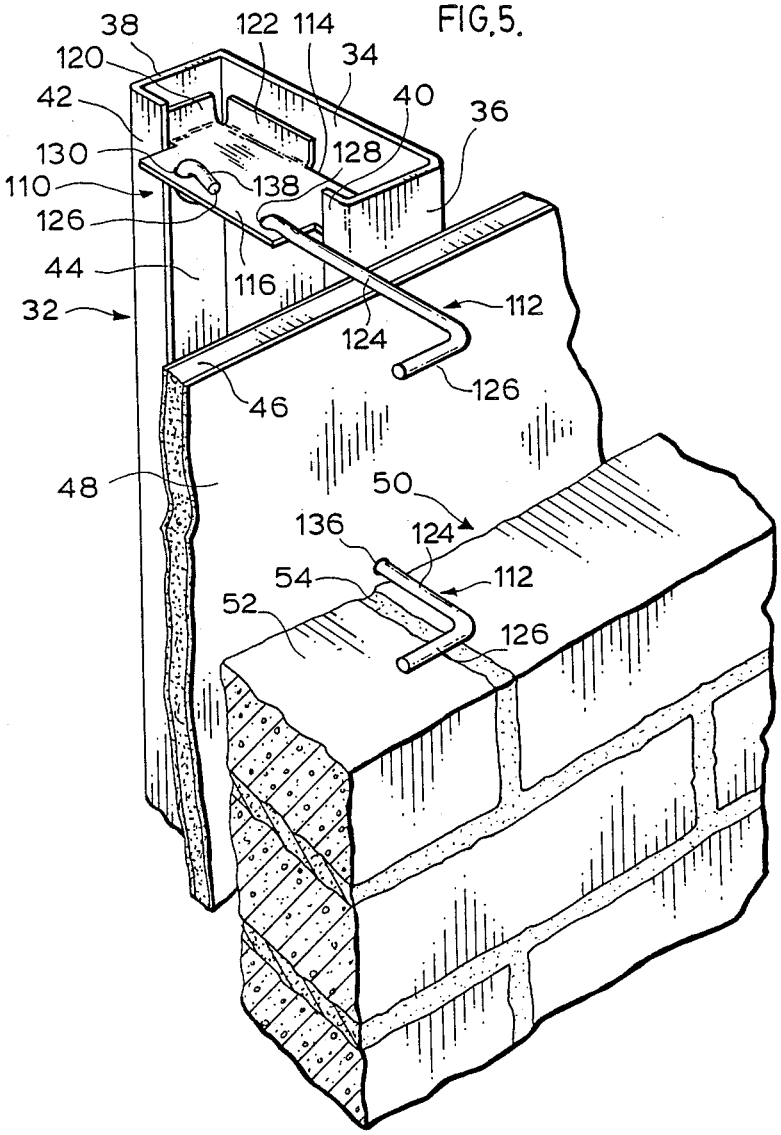
FIG. 5 is a broken away perspective view similar to FIG. 1, but showing another embodiment of the invention; and, FIG. 6 is a perspective view of the brick tie of FIG. 5.

An alternative embodiment is shown in FIGS. 5 and 6, and where applicable, the same or similar reference numerals will be used to indicate items which are identical or similar to those shown in FIGS. 1 to 4.

The first part 110 of the brick tie shown in FIGS. 5 and 6 has a body portion 114 with a horizontal web-like member 116, a front flange 118, an rear flange 120, an upward side flange 122 and a downward side flange 124. The web-like member 116 has a lateral extension 126 with two longitudinally-spaced apertures 128, 130. The second part 112 of the brick tie is a rod-like member with a straight forwardly extending main portion 132, and a transversely-extending front end portion 134. The rear part 136 of the second part 112 extends through the aperture 128 in the web-like member 116 of the first part 110 from the top to the bottom thereof and through the aperture 130 in the web-like member 116 from the bottom to the top thereof. As the rear portion 136 passes upwardly through aperture 130 to the top of web-like member 116, it is reversely bent to provide a short free end portion 138 lying on the top of the web-like member 116. The second brick tie part 112 is thereby secured to the first part 110.

During wall construction, holes 156 are made in the drywall panel 46 from within the building at calculated positions as described in connection with the previous embodiment. Each brick tie is then installed by pushing the transverse front portion 134 and adjacent part of the main portion 132 of the second part 112 through the hole 156, at the same time maneouvering the first part 110 into the channel-shaped member 32 through the side opening 44 and wedging the first part 110 in the channel-shaped member 32, again in a similar manner to that described in connection with the previous embodiment.

The advantages of the present invention will be readily apparent to a person skilled in the art from the above description of preferred embodiments. Other embodiments will also be readily apparent, the scope of the invention being defined in the appended claims.

I claim:

1. A brick tie for anchoring a brick wall to a vertical channel-shaped member open on one side and to which a wall panel has already been secured thereto said brick tie comprising a first part having a body portion insertable into the channel-shaped member through the open side thereof and wedgeable therein, said body portion having a main web-like member which extends horizontally across the channel-shaped member when wedged therein, a first flange extending downwardly from a front end of the web-like member and a second flange extending upwardly from a rear end of the web-like member, said first and second flanges engaging front and rear walls of the channel-shaped member when the first part is wedged therein, and a second part attachable to the first part and positionable between adjacent bricks as the wall is being constructed, one of said parts having means which is caused to pass through the wall panel from a rear face thereof adjacent the channel-shaped member and project from a front face of said wall panel as the first part is being wedged in the channel-shaped member.

2. A brick tie according to claim 1 wherein the body portion has a third flange extending upwardly from a side of the main web-like member and a fourth flange extending downwardly from said side, the third and fourth flanges engaging a side wall of the channel-shaped member opposite the open side when the first part is wedged therein.

3. A brick tie according to claim 1 wherein said means which is caused to pass through the wall panel comprises a portion projecting forwardly from the body portion of the first part said forwardly projecting portion having means to enable the second part to be secured thereto adjacent the front face of the wall panel.

4. A brick tie according to claim 3 wherein the means on the projecting portion to enable the second part to be secured thereto comprises an aperture therein, and the second part comprises a rod-like shaped member passable through the aperture so as to be secured to the first part.

5. A brick tie according to claim 4 wherein the aperture in the projecting portion comprising a slot which is vertical when the body portion is wedged in a vertical channel-shaped member, and the second part is vertically moveable in said slot.

6. A brick tie according to claim 1 wherein the first part has a portion projecting laterally from the body portion and positioned to project from the open side of the channel-shaped member when the body portion is wedged therein, said second part being secured to the laterally-projecting portion of the first part and providing said means which is caused to pass through the wall panel.

7. A brick tie according to claim 6 wherein the means on the laterally projecting portion of the first part comprises at least one aperture, and the second part comprises a shaped rod-like member having a rear portion positioned in the said of at least one aperture to secure the second part to the first part.

8. A wall construction comprising a series of horizontally spaced vertical channel-shaped members open at one side, a wall panel secured to the channel-shaped members, a brick wall adjacent to the wall panel on an opposite side thereof to the channel-shaped members, and a series of brick ties anchoring the wall panel to the channel-shaped members, each brick tie comprising a first part having a body portion wedged in a channel-shaped member, said body portion having a main web-like member which extends horizontally across the channel-shaped member, a first flange extending downwardly from an end of the web-like member and a second flange extending upwardly from an opposite end of the web-like member, the said first and second flanges engaging front and rear walls of the channel-shaped member, and a second part positioned between a pair of adjacent bricks in the wall and secured to the first part, one of the parts having a portion passing through the wall panel.

9. A wall construction according to claim 8 wherein the body portion of the first part of the brick tie also has a third flange extending upwardly from the side of the main web-like member and a fourth flange extending downwardly from the said side, the third and fourth flanges engaging a side wall of the channel-shaped member opposite the open side thereof.

10. A wall construction according to claim 8 wherein the first part of the brick tie has a portion projecting forwardly from the body portion and passing through the wall panel to an exterior side thereof, and said projecting portion has means securing the second part thereto on the exterior side of the wall panel.

11. A wall construction according to claim 10 wherein the means on the projecting portion on the first part of the brick tie securing the second part thereto comprises an aperture therein, and the second part comprises a shaped rod-like member passing through the aperture so as to be secured to the first part.

12. A wall construction according to claim 11 wherein the aperture in the projecting portion of the first part of the brick tie comprises a vertical slot, and the second part is vertically moveable in said slot.

13. A wall construction according to claim 8 wherein the first part of the brick tie has a portion projecting laterally from the body portion and projecting from the open side of the channel-shaped member, the second part has a portion passing through the wall panel, and the laterally projecting portion of the first part has means securing the second part thereto.

14. A wall construction according to claim 13 wherein the means on the laterally projecting portion of the brick tie comprises at least one aperture, and the second part comprises a shaped rod-like member positioned in the said at least one aperture to secure the second part to the first part.

* * * * *